United States Patent [19]

Tang et al.

[11] Patent Number: 4,804,620

[45] Date of Patent: Feb. 14, 1989

[54] PHOTOGRAPHIC MATERIAL CONTAINING A NOVEL POLYMERIC DYE-FORMING COUPLER

[75] Inventors: Ping-Wah Tang; Philip T. S. Lau; Stanley W. Cowan, all of Rochester; Harold I. Machonkin, Webster; Tien-Teh Chen, Penfield, all of N.Y.

[73] Assignee: Eastman Kodak Company, Rochester, N.Y.

[21] Appl. No.: 97,229

[22] Filed: Sep. 15, 1987

[51] Int. Cl.[4] ..... G03C 7/32; G03C 7/34; G03C 7/36; G03C 7/38

[52] U.S. Cl. ..... 430/548; 430/627

[58] Field of Search ..... 430/548, 381, 627

[56] References Cited

U.S. PATENT DOCUMENTS

| | | | |
|---|---|---|---|
| 2,389,575 | 11/1945 | Kirby et al. | 430/548 |
| 4,278,759 | 7/1981 | Saleck et al. | 430/627 |
| 4,455,366 | 6/1984 | Hirano et al. | 430/381 |
| 4,474,870 | 10/1984 | Yagihara et al. | 430/381 |
| 4,612,278 | 9/1986 | Lau et al. | 430/381 |
| 4,631,251 | 12/1986 | Komamura et al. | 430/548 |
| 4,656,124 | 4/1987 | Komamura | 430/548 |

FOREIGN PATENT DOCUMENTS

| | | | |
|---|---|---|---|
| 2019848 | 1/1987 | Japan | 430/548 |

OTHER PUBLICATIONS

*Research Disclosure*, Sep. 1985, Item 25724, Kenneth Mason Publications Ltd., Emsworth, Hampshire, England.

*Primary Examiner*—Richard L. Schilling
*Attorney, Agent, or Firm*—Joshua G. Levitt

[57] ABSTRACT

Color photographic elements contain polymeric dye-forming couplers in which the coupler moiety is joined to the polymer backbone via a linking group containing an ether moiety. Increased dye density yield is obtained.

8 Claims, No Drawings

PHOTOGRAPHIC MATERIAL CONTAINING A NOVEL POLYMERIC DYE-FORMING COUPLER

FIELD OF THE INVENTION

This invention relates to silver halide color photographic materials containing a novel polymeric dye-forming coupler. In a particular aspect it relates to such materials in which the coupler comprises a coupler moiety joined to a polymer backbone via a grouping which contains one or more ether linkages.

DESCRIPTION OF THE STATE OF THE ART

It is known that color photographic images can be formed by reaction between oxidized silver halide developing agent and a dye-forming coupler. For example, a coupler of the acylacetanilide or benzoylmethane type is used for forming a yellow dye image; a coupler of the pyrazolone, pyrazolobenzimidazole, cyanoacetophenone or indazolone type is used for forming a magenta dye image; and a phenolic or naphtholic coupler is used for forming a cyan dye image.

In the vast majority of materials in which a dye-forming coupler is employed to form a color image, the coupler is incorporated in the element prior to exposure. Color development leads to images in which a dye remains in the location were it was formed. With most such materials the coupler and the resulting dye are fixed in place as a result of bulk conferred on it by a ballast group. One such method of conferring bulk on a coupler to cause it to remain in place is to incorporate it in a polymer.

Two recent patents which describe polymeric couplers for use in photographic elements are U.S. Pat. Nos. 4,455,366, issued June 19, 1984, and 4,474,870, issued Oct. 2, 1984. These patents describe polymeric couplers formed from ethylenically unsaturated monomers in which the coupler moiety is joined to the polymer backbone via an optional linking group. The generic structure for these linking groups permits their being composed of a variety of individual moieties. However, the preponderance of materials which have a linking group contain an uninterrupted alkylene group between the polymer backbone and the coupler moiety.

While polymeric couplers with such linking groups have a number of beneficial effects, we have found that the activity of the coupler, and hence the dye density obtainable per unit coupler, is not as high as would be desired.

We have found that if the linking group between the coupler moiety and the polymer backbone contains an ether moiety, a coupler capable of yielding higher dye density is obtained.

SUMMARY OF THE INVENTION

In one aspect our invention relates to a photographic element comprising a support, a silver halide emulsion layer and a polymer dye-forming coupler comprising a polymer backbone, a coupler moiety and a linking group joining the polymer backbone and the coupler moiety wherein the linking group contains an —alkylene-O-alkylene— moiety wherein each alkylene group contains from 2 to 4 carbon atoms.

In a particular aspect, the linking group in the polymeric couplers of the invention is contained in repeating units derived from an ethylenically unsaturated monomer of the structure

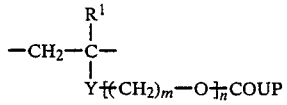

wherein $R^1$ is hydrogen chlorine or alkyl of 1–4 carbons;

Y is

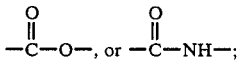

m is 2–4;

n is 2–6; and

COUP is a coupler moiety.

Representative examples of such coupler monomers are shown below:

Monomer 1

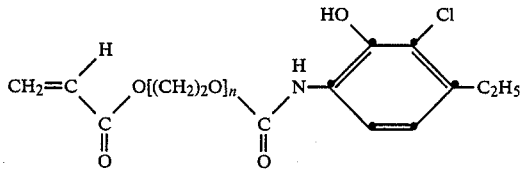

(a) n = 2

(b) n = 4

Monomer 2

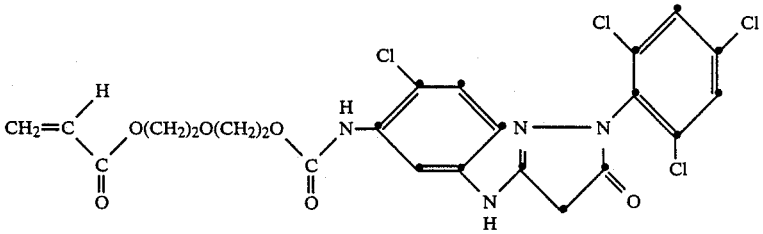

Monomer 3

-continued

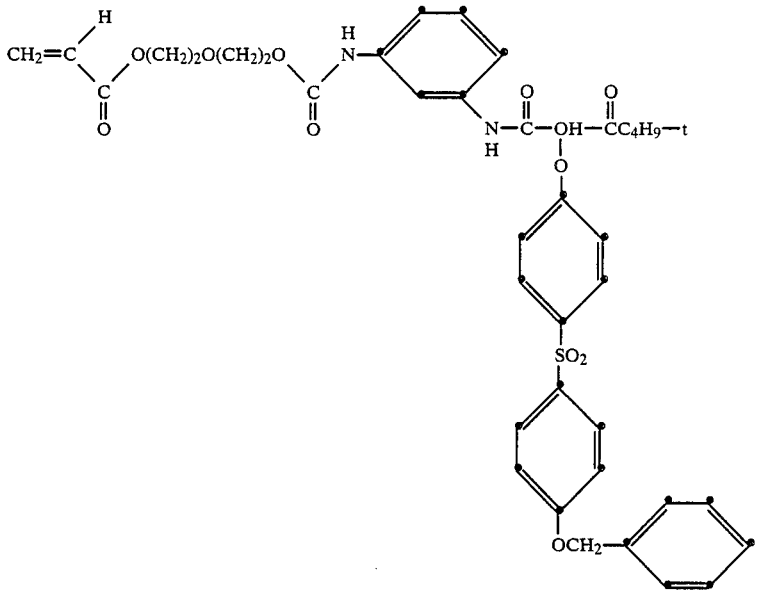

Monomer 4

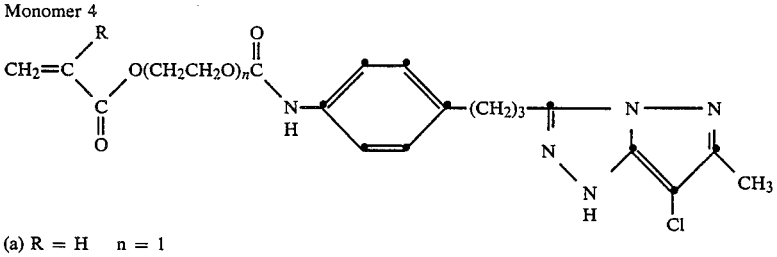

(a) R = H n = 1
(b) R = H n = 2
(c) R = H n = 3
(d) R = H n = 4
(e) R = $CH_3$ n = 1
(f) R = $CH_3$ n = 4

Monomer 5

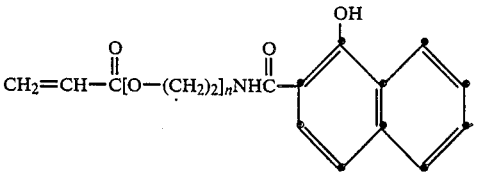

(a) n = 2
(b) n = 3

In yet another aspect the invention relates to processes of forming dye images in a photographic element containing a polymeric coupler as described above.

In still another aspect this invention relates to processed photographic elements containing dye images obtained by coupling of oxidized silver halide color developing agent and a polymeric coupler as described above.

The coupler moiety in the polymeric couplers of the invention includes any organic group that is capable of forming a dye upon reaction with an oxidized color developing agent. The COUP moiety is attached to the linking group through any position where a ballast could be attached.

Representative cyan dye-forming couplers from which the coupler moiety COUP can be derived are phenols and naphols as described in U.S. Pat. Nos. 2,367,531; 2,423,730; 2,474,293; 2,772,162; 2,895,826; 3,002,836 and 3,041,236.

Representative magenta dye-forming couplers from which the coupler moiety COUP can be derived are pyrazolones and pyrazolotriazoles as described in U.S. Pat. Nos. 2,343,703; 2,369,489; 2,600,788; 2,908,573; 3,062,6533,152,896 and 3,519,429.

Representative yellow dye-forming couplers from which the coupler moiety COUP can be derived are acylacetanilides as described in U.S. Pat. Nos. 2,875,057; 2,407,210; 3,265,506, 2,298,443; 3,048,194 and 3,447,928.

In a preferred embodiment the polymeric coupler contains an acrylate, methacrylate, acrylamide or methacrylamide polymer backbone and further comprises repeating units derived from non-coupler containing comonomers selected to provide useful physical and chemical properties for the polymeric coupler, such as a desired degree of solubility, compatibility with the components of the photographic materials, stability and flexibility. In an especially preferred embodiment, the polymer backbone of the polymeric couplers of the invention includes the alkoxyalcrylate comonomers disclosed in Lau and Tang U.S. Pat. No. 4,612,278, issued Sep. 16, 1986, which is incorporated herein by reference.

The polymeric couplers of this invention can be homopolymeric or copolymeric. While the ether containing coupler monomer, as described above, are preferably copolymerized with the alkoxyalkylacrylate monomers disclosed in U.S. Pat. No. 4,612,278, they can in addition or instead also be copolymerized with other suitable ethylenically unsaturated comonomers including, for example, acrylic acid, methacrylic acid, acylic acid esters, acrylic acid amides, vinyl esters, acrylonitrile, methacrylonitrile, aromatic vinyl compounds, vinylene chloride, itaconic acid and itaconic acid monoesters, citraconic acid, crotonic acid, maleic acid esters, N-vinyl-2-pyrrolidone, N-vinyl pyridine, vinyl alkyl esters such as methyl, ethyl, butyl, and aryl esters such as phenyl esters.

The optimum concentration of polymeric coupler in a photographic element according to the invention will depend on such factors as the desired image, particular processing conditions, particular processing compositions, the particular polymeric coupler, location of the polymeric coupler in the photographic element, and the like. For example, the polymeric coupler can be incorporated within the range of $10^{-4}$ to $10^{-1}$ mole of polymeric coupler per mole of silver in the photographic element.

Photographic elements in which the polymeric couplers of this invention are incorporated can be a simple element comprising a support and a single silver halide emulsion layer or, preferably, they can be multilayer, multicolor elements. The polymeric couplers of this invention can be incorporated in the silver halide emulsion layer or in another layer, such as an adjacent layer, where they will come into reactive association with oxidized color developing agent which has developed silver halide in the emulsion layer. The silver halide emulsion layer can contain, or have associated with it, other photographic coupler compounds, such as color forming couplers, colored masking couplers, competing couplers and the like. These other photographic coupler compounds can form dyes of the same or different color and hue as the polymeric coupler compounds of this invention. Additionally, the silver halide emulsion layer can contain addenda conventionally contained in such layers.

A typical multilayer, multicolor photographic element according to this invention can comprise a support having thereon a red-sensitive silver halide emulsion layer unit having associated therewith a cyan dye image providing material, a green-sensitive silver halide emulsion layer unit having associated therewith a magenta dye image providing material, and a blue-sensitive silver halide emulsion layer unit having associated therewith a yellow dye image providing material, at least one of the silver halide emulsion layers having associated therewith a polymeric coupler of the invention. Each silver halide emulsion unit can be composed of one or more layers and the various units and layers can be arranged in different locations with respect to one another. The polymeric couplers of this invention can be incorporated in or associated with one or more layers or units of the element.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct-positive emulsions. They can form latent images predominantly on the surface of the silver halide grains or predominantly in the interior of the silver halide grains. They can be chemically and spectrally sensitized. The emulsions typically will be gelatin emulsions although other hydrophilic colloids can be used in accordance with usual practice. Particularly useful photographic silver halides are tabular grain photographic silver halides, such as those described in *Research Disclosure,* January 1983, Item No. 22534, and U.S. Pat. No. 4,434,226.

The polymeric couplers of this invention can be used in the ways for the purposes that dye-forming couplers are used in the photographic art.

In the following discussion of suitable materials for use in the emulsions and elements of this invention, reference will be made to *Research Disclosure,* December 1878, Item 17643, published by Industrial Opportunities Ltd, Homewell Havant, Hampshire, PO9 1EF, UK, the disclosures of which are incorporated herein by reference. This publication will be identified hereinafter as *Research Disclosure*

The emulsion layers employed in the elements of this invention can contain the vehicles as described in *Research Disclosure,* Section IX, and the publications cited therein.

In addition to the polymeric couplers of this invenion, the elements can include additional couplers as described in *Research Disclosure,* Section VII, paragraphs D, E, F and G, and the publications cited therein. These additional couplers can be incorporated in the elements and the emulsions as described in *Research Disclosure,* Section VII, paragraph C, and the publications cited therein.

The photographic elements of this invention or individual layers thereof can contain brighteners (see *Research Disclosure,* Section V), antifoggants and stabilizers (see *Research Disclosure,* Section VI), antistain agents and image dye stabilizers (see *Research Disclosure,* Section VII, paragraphs I and J), light-absorbing and -scattering materials (see *Research Disclosure,* Section VIII), hardeners (see *Research Disclosure,* Section XI), plasticizers and lubricants (see *Research Disclosure,* Section XII) and development modifiers (see *Research Disclosure,* Section XXII).

The hydrophobic polymeric couplers according to the invention can be dispersed in a hydrophilic colloid, such as gelatin, by processes known in the photographic art. A latex loading process can be useful. For example, the hydrophobic polymeric coupler can be loaded into a polymeric latex. Alternatively, the hydrophobic polymeric coupler can be loaded into a polymeric coupler latex. Loading processes and techniques are useful which are known in the photographic art.

To enhance physical and performance characteristics such as dispersion stability, bending property and dye hue of the color photographic material containing polymeric couplers of the invention, small quantities of a permanent solvent, such as a water-insoluble, high boiling organic solvent, may be added. The quantity of such added permanent solvent should be such that the polymeric coupler is plasticized while being maintained in solid particle form, and the thickness of the emulsion layers be reduced as much as feasible to ensure good image sharpness.

The photographic elements can be coated on a variety of supports as described in *Research Disclosure,* Section XVII, and the references cited therein.

Photographic elements can be exposed to actinic radiation, typically in the visible region of the spectrum, to form a latent image as described in *Research Disclosure,* Section XVIII Processing to form a visible dye image includes the steps of contacting the element with a color developing agent to reduced developable silver halide and oxidize the color developing agent. Oxidized color developing agent in turn reacts with the coupler to yield a dye.

Preferred color developing agents are p-phenylenediamines. Especially preferred are 4-amino-N,N-diethylaniline hydrochloride, 4-amino-3-methyl-N-ethyl-N-β-(methanesulfonamido) ethylaniline sulfate hydrate, 4-amino-3-methyl-N-ethyl-N,N-diethylaniline sulfate, 4-amino-3-(methanesulfonamido)ethyl-N,N-diethylaniline hydrochloride and 4-amino-N-ethyl-N-(2-methoxyethyl)-m-toluidine di-p-toluene sulfonic acid.

Development is followed by the conventional steps of bleaching, fixing or bleach-fixing, to remove silver and silver halide, washing and drying.

The polymeric couplers according to this invention can be prepared by procedures generally known in the organic compound synthesis art.

The monomer from which the polymer is prepared can be synthesized by sequential reactions which join the linking group to either the polymerizable precursor of the polymer backbone or the coupler moiety and then joins that combination with the remaining portion of the monomer. The resulting monomer is then homopolymerized or copolymerized with oher vinyl monomers by known polymerization techniques.

The polymeric couplers are preferably prepared in the form of a latex, such as by emulsion polymerization or by dissolving an oleophilic polymeric coupler, as described, obtained by copolymerization of suitable ethylenically unsaturated monomers in an organic solvent and then dispersing the solution in latex form in an aqueous gelatin solution. Emulsion polymerization methods described in, for example, U.S. Pat. Nos. 4,080,211 and 3,370,952 are useful regarding dispersing an oleophilic polymeric coupler, as described, in latex form in an aqueous gelatin solution. The ether link containing monomer and/or any added monomers can be in liquid form which can act, in the case of emulsion polymerization, as a solvent for one or more of the reactants.

The polymeric couplers can also be prepared by a solution polymerization method. This method comprises polymerization of the described monomers in solution in a useful solvent, such as tetrahydrofuran (THF) or chlorinated hydrocarbon solvents, for example, trichloroethylene.

The following provide illustrations of specific compound syntheses:

In Reaction 1 polyethylene glycol is attached to an acrylate monomer. The resulting polyethylene glycol monoacrylate then is attached to the coupler monomer as illustrated in Reaction 2. In these reactions, the following abbreviations are used: THF is tetrahydrofuran; DMA is dimethylaniline; DMF is dimethylformamide.

Reaction 1

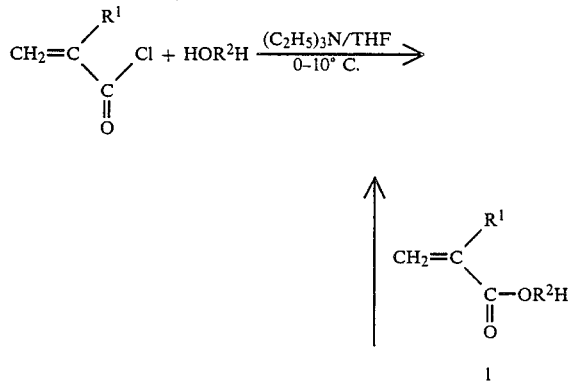

where $R^1$ is as defined above $R^2$ is $[(CH_2)_m—O]_n$ where m and n are as defined above The reaction is run at low temperature to prevent any undesired polymerization. Monoester (1) is separated from any undesired diester and the starting materials by column chromatography with methanol/ethyl acetate (5/95 or 10/90) as eluent. The yield is between 40 to 60% depending on the efficiency of the chromatography.

Reaction 2

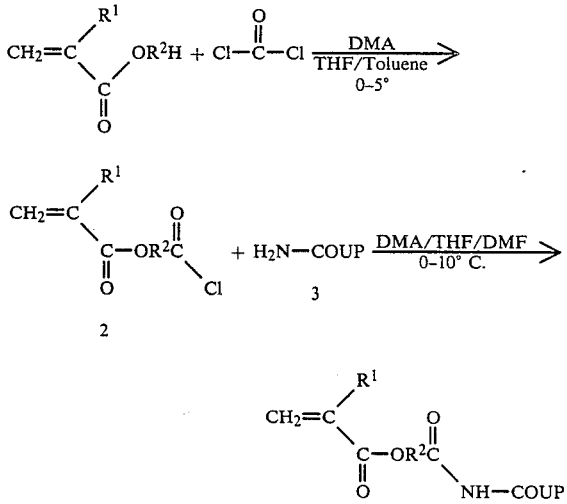

The conversion of the hydroxyl group to the corresponding chloroformate (2) with excess phosgene is followed by the removal of unreacted phosgene in a rotary evaporator. A solution containing 20% excess chloroformate is then added to the coupler (3) in the presence of dimethylaniline. The solution mixture is then poured into a dilute solution of hydrochloric acid and extracted with ethyl acetate. After evaporation of the ethyl acetate, the product obtained can be used directly without further purification. The yields are generally quantitative.

In an alternative synthesis, illustrated by Reactions 3, 4 and 5, the ether linking group is joined to the coupler and then to an acrylate monomer.

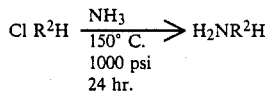
(3)
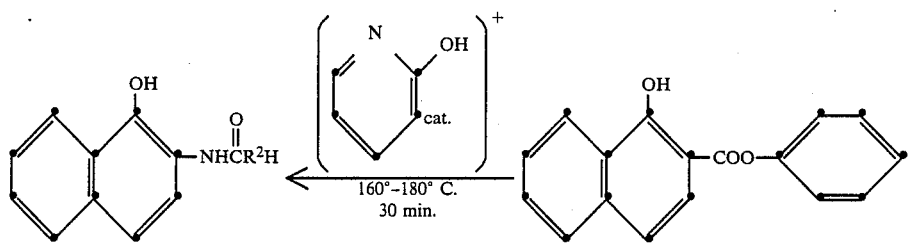
(4)
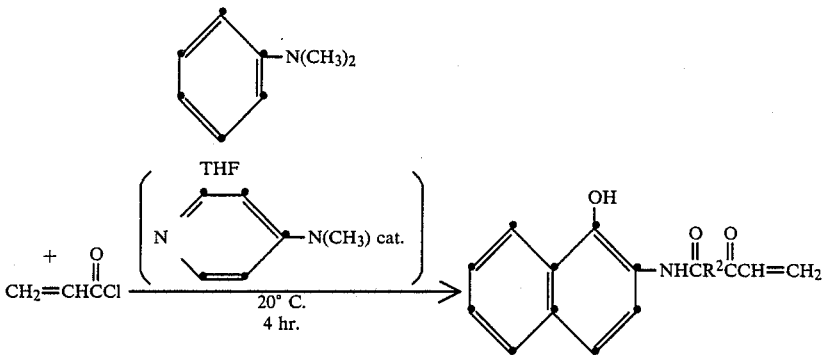
(5)
The resulting monomers are polymerized by one of the techniques illustrated by Reaction 6, which shows emulsion polymerization and Reaction 7, which shows solution pollymerization.
Reaction 6
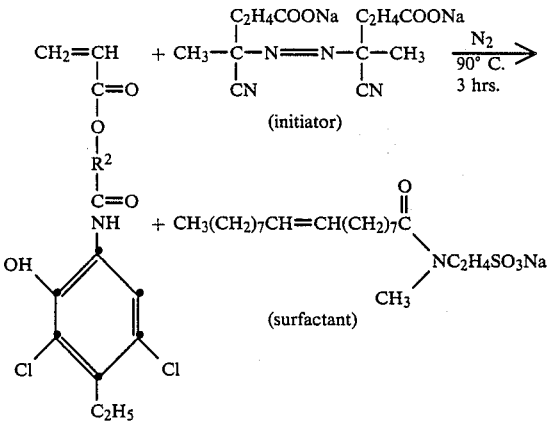
-continued
Reaction 6
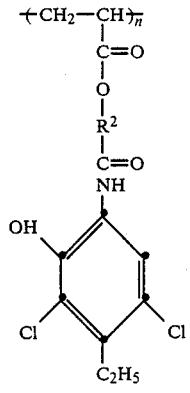

Reaction 7

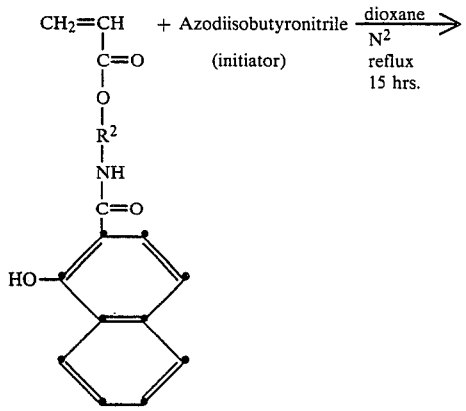

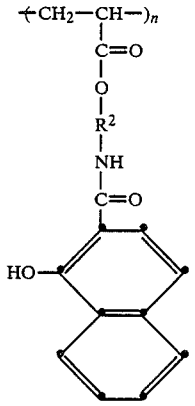

The following examples further illustrate this invention. In these examples the coating rate, in g/m$^2$ or moles/m$^2$ is shown in parentheses.

EXAMPLE 1

A photographic film was prepared by coating the following layers on a poly(ethylene terephthalate) film support:

| |
|---|
| Gelatin (1.08 g/m$^2$) |
| bis (vinylsulfonylmethyl)ether (hardener) (0.09 g/m$^2$) |
| Gelatin (3.77 g/m$^2$) |

-continued

| |
|---|
| polymeric coupler (1.5 × 10$^{-3}$ mole/m$^2$) |
| polydispersed sulfur and gold |
| sensitized AgBrI (6.5% I) gelatino emulsion |
| Film Support |

The AgBrI gelatino emulsion layer was coated at 0.907 Ag/m$^2$ for the couplers listed in Table I. The photographic film was imagewise exposed to a graduated density test object and then processed at a temperature of 40° C. in the following sequence:

| | |
|---|---|
| Color development | 2 min |
| Stop bath | 2 min |
| Water wash | 2 min |
| Bleach | 2 min |
| Water wash | 3 min |
| Fix | 2 min |
| Dry | |

| | |
|---|---|
| Color developer composition | |
| Potassium sulfate | 2.0 g |
| 4-Amino-3-methyl-N—ethyl-N—β-hydroxyethylaniline sulfate | 3.55 g |
| Potassium carbonate (anh.) | 30.0 g |
| Potassium bromide | 1.25 g |
| Potassium iodide | 0.6 g |
| Water to 1 liter | Adjusted to pH 10.0 |
| Stop bath composition | |
| Glacial acetic acid | 30.00 ml |
| Water to 1 liter | |
| Bleach composition | |
| Sodium bromide | 21.5 g |
| Potassium ferricyanide | 100.0 g |
| $NaH_2PO4.H_2O$ | 0.07 g |
| Water to 1 liter | Adjusted to pH 7.0 |
| Fix composition | |
| $Na_2S_2O_3.10H_2O$ | 250.0 g |
| $NaHSO_3$ | 1.5 g |
| $NaSO_3$ | 6.0 g |
| Water to 1 liter | Adjusted to pH 7.0 |

In this and the following examples the red dye density in the processed photographic element was determined at that point on the sensitometric curve where 0.43 g Ag/m$^2$ was developed. The ratio of dye density to developed silver was designated as relative Dmax and is a measure of the yield of dye per unit developed silver. In these examples couplers of the invention are identified by an arabic numeral designation while comparison couplers are identified by a letter designation. The results are shown in Table I.

TABLE I

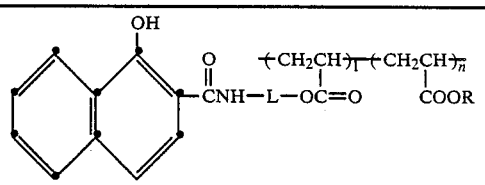

| | L | R | n | Dmax | Rel. Dmax |
|---|---|---|---|---|---|
| Coupler A | —$(CH_2)_3$— | n-$C_4H_9$ | (2) | 0.56 | 0.26 |
| Coupler 1 | —$(CH_2CH_2$—O—$CH_2CH_2)$— | n-$C_4H_9$ | (2) | 1.92 | 0.89 |
| Coupler B | —$(CH_2)_3$— | n-$C_4H_9$ | (4) | 0.46 | 0.21 |
| Coupler 2 | —$(CH_2CH_2$—O—$CH_2CH_2)$— | n-$C_4H_9$ | (4) | 1.83 | 0.85 |
| Coupler C | —$(CH_2)_3$— | $CH_2CH_2OC_2H_5$ | (2) | 1.81 | 0.84 |
| Coupler 3 | —$(CH_2CH_2$—O—$CH_2CH_2)$— | $CH_2CH_2OC_2H_5$ | (2) | 2.21 | 1.11 |
| Coupler D | —$(CH_2)_3$— | $CH_2CH_2OC_2H_5$ | (4) | 1.85 | 0.86 |

TABLE I-continued

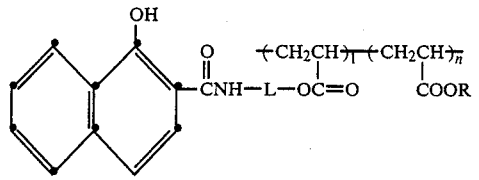

| | L | R | n | Dmax | Rel. Dmax |
|---|---|---|---|---|---|
| Coupler 4 | $-(CH_2CH_2-O-CH_2CH_2)-$ | $CH_2CH_2OC_2H_5$ | (4) | 2.33 | 1.17 |

The data indicate that the polymeric couplers according to the invention provide significantly higher dye yield than the comparison polymeric couplers.

EXAMPLE 2

Example 1 was repeated except that photographic elements contained the polymeric couplers listed in Table II. The results are shown in Table II.

TABLE II

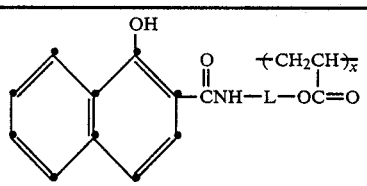

| | L | Dmax | Rel. Dmax |
|---|---|---|---|
| Coupler E | $-(CH_2)_3-$ | 0.88 | 0.40 |
| Coupler F | $-(CH_2)_5-$ | 0.78 | 0.36 |
| Coupler 5 | $-(CH_2CH_2OCH_2CH_2)-$ | 1.02 | 0.47 |
| Coupler G | $-(CH_2)_3-$ | 0.96 | 0.45 |
| Coupler 6 | $-(CH_2CH_2OCH_2C_2)-$ | 2.05 | 0.97 |

EXAMPLE 3

Example 1 was repeated except that the polymeric couplers were as shown in Table III, the AgBrI gelatino emulsion layer was coated at 0.453 Ag/m2 and the color developing solution contained 5.0 g/L of the color developing agent 4-amino-3-methyl-N-β-(methanesulfonamido) ethylaniline. The results are shown in Table III.

TABLE III

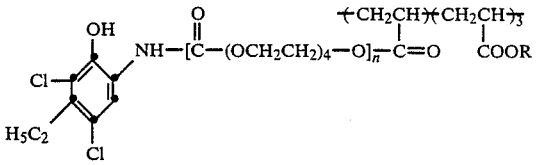

| | n | R | Dmax |
|---|---|---|---|
| Coupler H | 0 | $C_4H_9-n$ | 1.49 |
| Coupler 7 | 1 | $C_4H_9-n$ | 1.97 |
| Coupler I | 0 | $CH_2CH_2OC_2H_3$ | 2.05 |
| Coupler 8 | 1 | $CH_2CH_2OC_2H_3$ | 2.22 |

EXAMPLES 4–6

Additional comparisons between polymeric couplers of the invention and comparison polymeric couplers are recorded in Tables IV, V and VI of Examples 4, 5, and 6, respectively.

TABLE IV

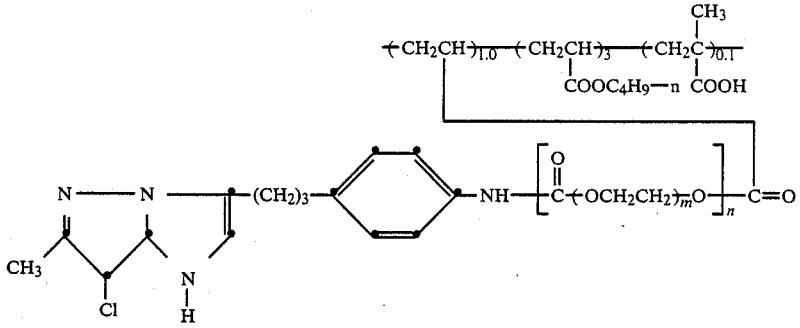

| | n | m | Dmax |
|---|---|---|---|
| Coupler J | 0 | 0 | 1.41 |
| Coupler 9 | 1 | 2 | 2.25 |
| Coupler 10 | 1 | 3 | 2.62 |
| Coupler 11 | 1 | 4 | 2.76 |

EXAMPLE 5

TABLE V

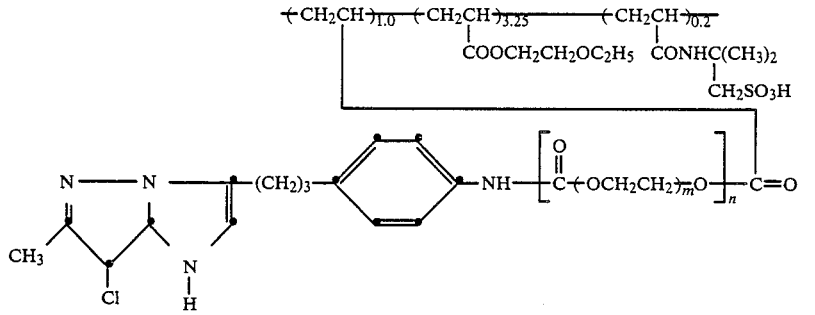

| | n | m | Dmax |
|---|---|---|---|
| Coupler K | 0 | 0 | 1.43 |
| Coupler 12 | 1 | 1 | 1.55 |
| Coupler 13 | 1 | 3 | 1.82 |

EXAMPLE 6

TABLE VI

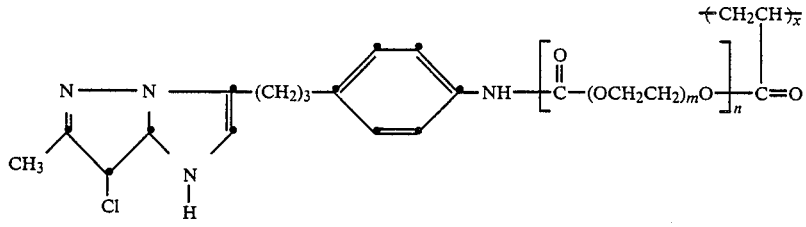

| | n | m | Dmax |
|---|---|---|---|
| Coupler 14 | 1 | 2 | 0.49 |
| Coupler 15 | 1 | 3 | 1.03 |
| Coupler 16 | 1 | 4 | 1.67 |

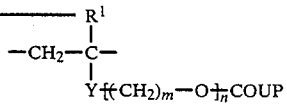

What is claimed is:

1. A photographic element comprising
a support,
a silver halide emulsion layer, and
a polymeric dye-forming coupler comprising
an acrylate polymeric backbone,
a coupler moiety and
a linking group joining the polymeric backbone and the coupler moiety wherein the linking group contains an alkylene-O-alkylene moiety directly attached to an oxygen atom of the acrylate polymeric backbone and each alkylene group contains from 2 to 4 carbon atoms.

2. A photographic element of claim 1 wherein the polymer is a copolymer that contains repeating units derived from one or more non-coupler monomers.

3. A photographic element of claim 2 wherein the non-coupler monomer is an alkoxyalkylacrylate comonomer.

4. A photographic element of claim 1 wherein the polymeric coupler contains repeating units having the structure:

wherein
$R_1$ is hydrogen;
Y is

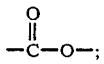

m is 2–4;
n is 2–6; and
COUP is a coupler moiety.

5. A multilayer, multicolor photographic element of claim 4 having silver halide emulsion layer units sensitive to the red-, green-, or blue-regions of the spectrum and containing, respectively, a cyan-, magenta-, or yellow-dye-forming coupler, the polymeric coupler being contained in one or more of the emulsion layer units.

6. An element of claim 5 wherein the polymeric coupler is a cyan dye-forming coupler.

7. An element of claim 5 wherein the polymeric coupler is a magenta dye-forming coupler.

8. An element of claim 5 wherein the polymeric coupler is a yellow dye-forming coupler.

* * * * *